US012703980B2

(12) United States Patent
Wallace

(10) Patent No.: US 12,703,980 B2
(45) Date of Patent: Aug. 11, 2026

(54) METHOD AND APPARATUS FOR A RAIN GUTTER SYSTEM

(71) Applicant: Freedom Carrier LLC, Mesa, AZ (US)

(72) Inventor: Michael T. Wallace, Payson, AZ (US)

(73) Assignee: Freedom Carrier LLC, Mesa, AZ (US)

( * ) Notice: Subject to any disclaimer, the term of this patent is extended or adjusted under 35 U.S.C. 154(b) by 143 days.

(21) Appl. No.: 18/766,533

(22) Filed: Jul. 8, 2024

(65) Prior Publication Data

US 2025/0012083 A1 Jan. 9, 2025

Related U.S. Application Data

(60) Provisional application No. 63/525,692, filed on Jul. 9, 2023.

(51) Int. Cl.
*E04D 13/076* (2006.01)

(52) U.S. Cl.
CPC ..... *E04D 13/0767* (2013.01)

(58) Field of Classification Search
CPC ..... E04D 13/0767; E04D 13/64; E04D 2013/0413
USPC ..... 52/12, 16
See application file for complete search history.

(56) References Cited

U.S. PATENT DOCUMENTS 4,951,430 A * 8/1990 Gottlieb ..... E04D 13/0641 248/48.1
5,170,596 A * 12/1992 Zadok ..... E04D 13/064 52/12
5,230,798 A * 7/1993 Rogman ..... B01D 29/96 52/12
5,802,776 A * 9/1998 Murray ..... E04D 13/076 52/12
5,882,508 A * 3/1999 St-Jacques ..... E03F 1/002 210/170.03
6,115,970 A * 9/2000 Wilczynski ..... E04D 13/08 52/12
6,944,991 B2 * 9/2005 Kim ..... E04D 13/076 52/12
8,496,810 B2 * 7/2013 Forrest ..... E04D 13/08 52/12
8,646,217 B2 * 2/2014 Ratajac ..... E04D 13/0725 52/12
10,053,867 B2 * 8/2018 Sinclair ..... E04D 13/0481
12,497,778 B2 * 12/2025 Chambery ..... E04D 13/0767
2002/0073630 A1 * 6/2002 Warns ..... E04D 13/064 52/12
2004/0031209 A1 * 2/2004 Porter ..... E04D 13/08 52/12

(Continued)

*Primary Examiner* — Paola Agudelo
(74) *Attorney, Agent, or Firm* — Michael T. Wallace

(57) ABSTRACT

A rain gutter system is provided that allows the collection of a combination of precipitation and debris from a roof top of a building during a precipitation event (e.g., a thunderstorm) within an interior of a rain gutter of the rain gutter system. The rain gutter system includes one or more rain gutter traps that filter the debris from the precipitation and trap the debris away from the rain gutter's downspout prior to allowing the precipitation to channel away from the building. The one or more rain gutter traps are configured with hinged doors and/or removably attachable components for ease of removal of the trapped debris.

3 Claims, 6 Drawing Sheets

(56) References Cited

U.S. PATENT DOCUMENTS

| | | | | |
|---|---|---|---|---|
| 2005/0016076 | A1* | 1/2005 | Spradlin | E04D 13/0641 52/11 |
| 2005/0109693 | A1* | 5/2005 | Allard | B01D 35/02 210/162 |
| 2006/0278573 | A1* | 12/2006 | Robinson | E04D 13/0767 52/12 |
| 2007/0125005 | A1* | 6/2007 | Carson | E04D 13/076 52/11 |
| 2010/0043831 | A1* | 2/2010 | Koenig | E04D 13/076 52/12 |
| 2011/0203191 | A1* | 8/2011 | Argentina | E04D 13/0645 52/12 |
| 2024/0093498 | A1* | 3/2024 | Hoke | E04D 13/0645 |

* cited by examiner

METHOD AND APPARATUS FOR A RAIN GUTTER SYSTEM

FIELD OF THE INVENTION

The present invention generally relates to rain gutters, and more particularly to rain gutter systems that substantially prevent rain gutter blockage.

BACKGROUND

Conventional rain gutters may be utilized to first gather precipitation (e.g., rain, snow, ice, etc.) that rolls/melts off building roof tops and then channel the precipitation away from areas that are adjacent and/or attached to the building via one or more downspouts that may be attached to the rain gutter. As such, conventional rain gutters prevent damage to the building that might otherwise occur if the precipitation collected by the rain gutters were allowed to puddle at the building's foundation, wash across fascia, or otherwise make contact with areas of the building that may be susceptible to water damage.

Conventional rain gutter systems (e.g., prior art rain gutter system 100 of FIG. 1), however, are likewise proficient at collecting debris (e.g., leaves, pine needles, pine cones, trash, etc. not shown) that may be washed into rain gutter 102 along with the collected precipitation. As collected precipitation 108 travels down the length of rain gutter 102 towards downspout egress 104 and downspout 106, so does collected debris, which may generally collect at downspout egress 104 thereby resulting in the complete blockage of rain gutter 102 by the collected debris. As a result, collected precipitation 108 is not allowed to channel away from the building via downspout 106 as channeled precipitation 110, but rather overflows over an edge of rain gutter 102 (e.g., edge 112 of rain gutter 102) as overflow precipitation 116 and allowed to collect at the building's foundation (not shown) as if rain gutter 102 were not present.

Conventional rain gutter 102, therefore, may be rendered ineffective for its intended purpose until such time that the debris causing the blockage is removed. Unfortunately, conventional rain gutters do not allow for the removal of the collected debris except by repeated "scooping" motions that may utilize the human hand, or a handheld utensil, to remove the collected debris out of open end 114 from the entire length of conventional rain gutter 102 where debris has been collected. Further cleaning of downspout egress 104 and downspout 106 may generally be required as well, since a portion of the collected debris may be allowed access to downspout 106. Cleaning of downspout 106, however, may further require the partial disassembly of downspout 106 from conventional rain gutter 102 as well.

Conventional screening devices (not shown) may be deployed and arranged over open end 114 along edges 112 and 116 of conventional rain gutter 102 such that debris that would otherwise be collected within an interior of rain gutter 102 may instead be blocked from entering open end 114 of conventional rain gutter 102. Unfortunately, however, such screening devices may also operate to disallow a majority of collected precipitation 108 that would otherwise be collected by rain gutter 102 to instead be deflected away from rain gutter 102 as overflow precipitation 116 especially during high-flow-rate precipitation events (e.g., a thunderstorm). As such, the screening devices may cause the precipitation to simply roll off of the top of the screening device, thereby avoiding collection by rain gutter 102 and defeating the purpose of rain gutter 102 by allowing the precipitation to puddle at the building's foundation rather than to be channeled away from the building's foundation via downspout 106.

Efforts continue, therefore, to develop a rain gutter system that allows collection of both precipitation and debris in such a way that disallows the debris from blocking the downspout egress while simultaneously allowing the collected precipitation to channel away from the building via operation of the downspout.

SUMMARY

To overcome limitations in the prior art, and to overcome other limitations that will become apparent upon reading and understanding the present specification, various embodiments of the present invention disclose a rain gutter system that allows collection of both precipitation and debris while preventing the debris from blocking the downspout egress while simultaneously allowing the collected precipitation to channel away from the building via operation of the downspout. In one embodiment, a rain gutter trap may provide a single interior chamber within which both debris and precipitation may be collected. As the debris traps to the bottom of the chamber via gravity, collected precipitation may be allowed to separate from and rise above the trapped debris to eventually be channeled away via the downspout egress.

Other embodiments may provide a first chamber within which precipitation and debris may be collected and second chamber separated from the first chamber by a screening element. The screening element may be used to trap the debris within the first chamber while allowing the collected precipitation to proceed to the second chamber for downspout egress. Such rain gutter traps may employ elements (e.g., water-proof hinged doors) that when disengaged from the rain gutter trap allow access to the debris collected within an interior of the rain gutter trap for ease of cleaning. Other embodiments may allow for the rain gutter trap to be removably attached to the rain gutter such that detachment from the rain gutter allows the dumping of the debris collected within the rain gutter trap into a garbage receptacle.

In accordance with one embodiment of the invention, a rain gutter system comprises a rain gutter, a downspout coupled to the rain gutter and a rain gutter trap system removably coupled to the rain gutter. The rain gutter trap system includes at least one component configured to allow passage of water from the rain gutter to the downspout while blocking debris from the downspout during a first mode and configured to be removed from the rain gutter and emptied during a second mode.

In accordance with another embodiment of the invention, a method of collecting debris from a rain gutter comprises coupling a receptacle to a rain gutter, allowing water collected by the rain gutter to flow into the receptacle, allowing water collected by the receptacle to flow into a downspout, trapping debris in the receptacle, decoupling the receptacle from the rain gutter, emptying the debris from the receptacle and coupling the receptacle to the rain gutter.

BRIEF DESCRIPTION OF THE DRAWINGS

Various aspects and advantages of the invention will become apparent upon review of the following detailed description and upon reference to the drawings in which.

DETAILED DESCRIPTION

Generally, the various embodiments of the present invention are applied to a rain gutter system that includes a rain gutter trap that allows the rain gutter to collect both precipitation and debris while providing mechanisms that separate the collected debris from the collected precipitation before the collected precipitation is allowed egress from the rain gutter into the downspout. As such, a collection chamber traps the debris (e.g., by operation of gravity, screening, or both) such that the debris is disallowed proximity to the downspout egress. Hinged, waterproof doors may be provided to allow the collection chamber of the rain gutter trap to be cleared of collected debris. In other embodiments, one or more collection chambers of the rain gutter trap may be removably attached to the rain gutter such that one or more collection chambers may be removed for cleaning and subsequently reattached to the rain gutter.

Figure 1:
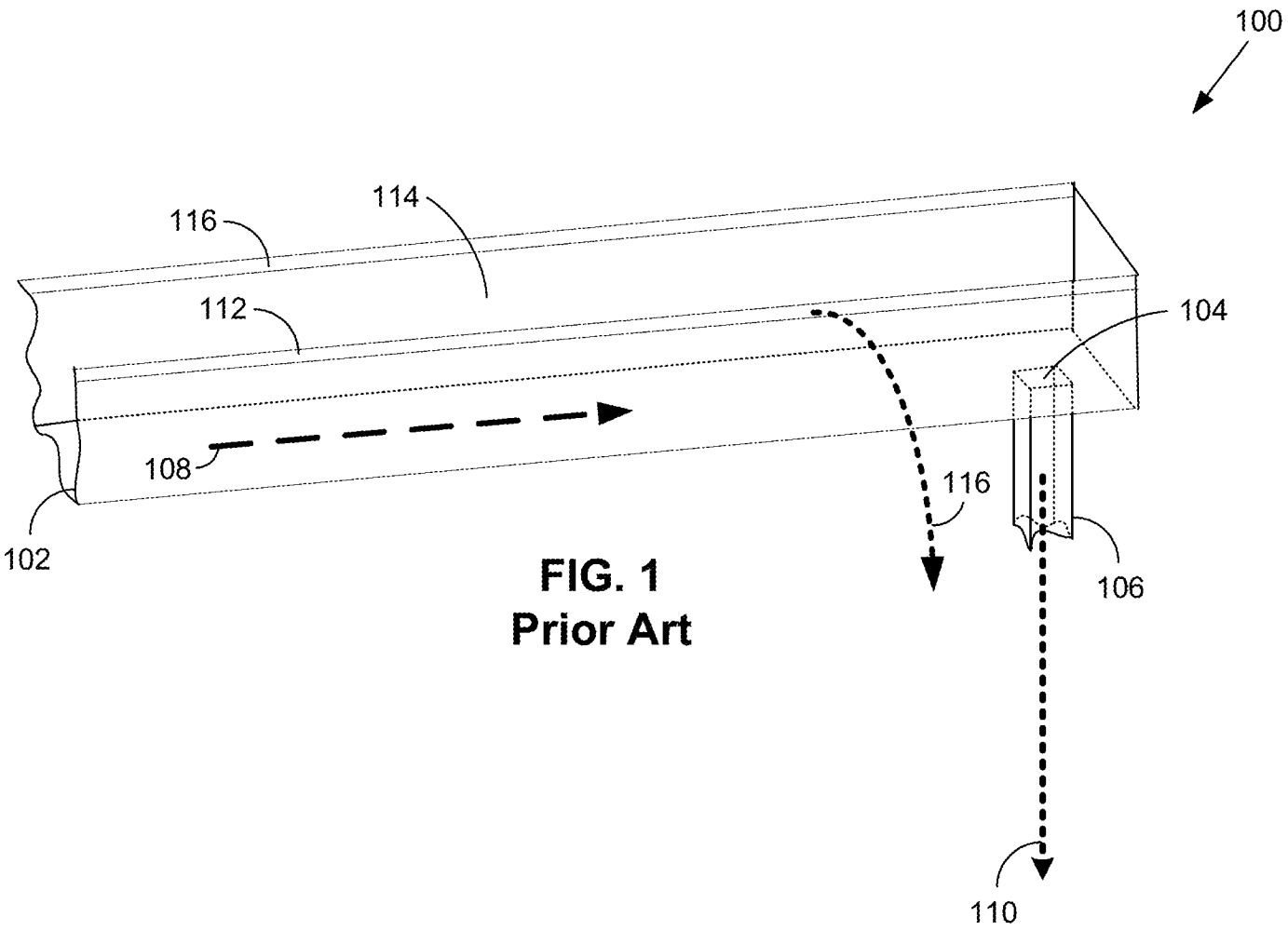
FIG. 1 Prior Art
FIG. 1 illustrates a prior art rain gutter system.
Figure 2:
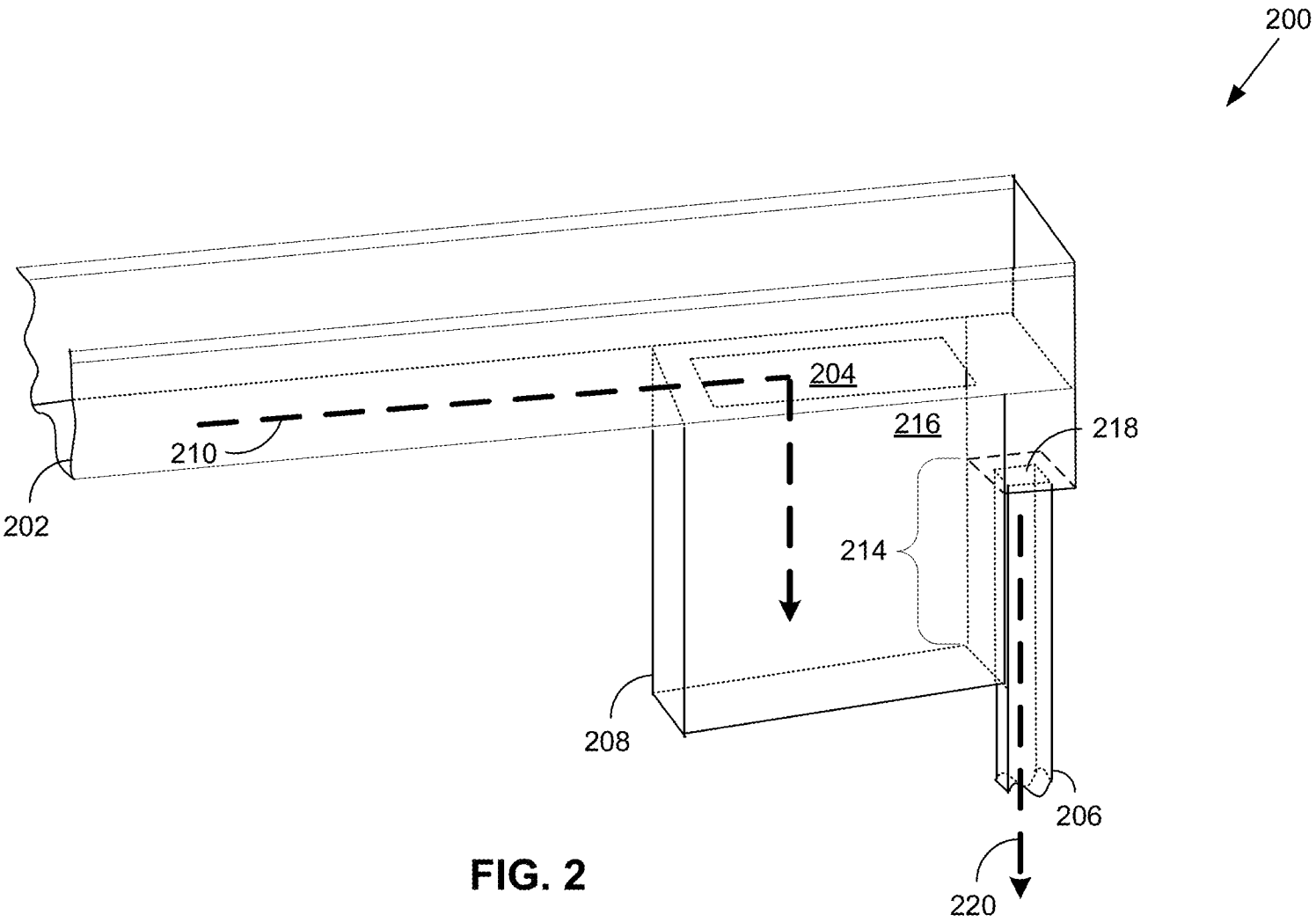
FIG. 2 illustrates a partial view of a rain gutter system including a rain gutter trap in accordance with an embodiment of the present invention.

Turning to FIG. 2, rain gutter system 200 is exemplified that may include rain gutter 202 having chamber ingress 204 that may accept flow 210 comprising one or more of precipitation (e.g., rain, melted snow/ice, etc.) and debris (e.g., leaves, pine needles, pine cones, etc.) into chamber 216. As flow 210 enters chamber 216 of rain gutter trap 208 via ingress 204, the debris component of flow 210, if any, may settle to the bottom of chamber 216 through operation of gravity while the precipitation component of flow 210 may rise above the debris and may be allowed to egress chamber 216 via downspout egress 218 as clear water flow 220.

As chamber 216 fills with debris, portion 214 of chamber 216 may block debris from accessing downspout egress 218 thereby preventing blockage of downspout 206. Once debris rises within chamber 216 to the height of portion 214, chamber 216 may be cleared of debris so that rain gutter trap 208 may continue to effectively separate debris from precipitation thereby maintaining clog-free operation of downspout 206.

Figure 3:
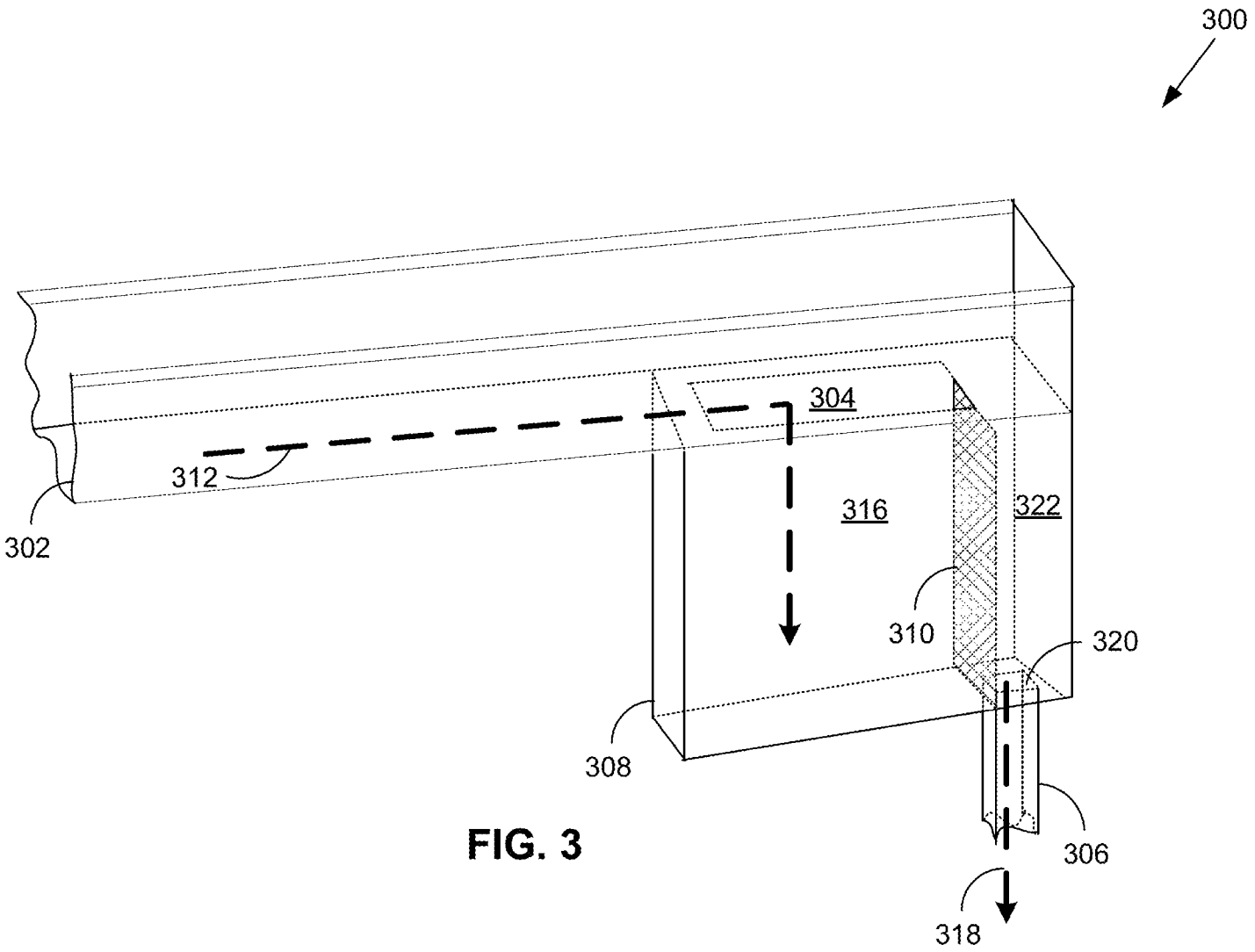
FIG. 3 illustrates a partial view of a rain gutter system including a rain gutter trap in accordance with an alternate embodiment of the present invention.

Turning to FIG. 3, rain gutter system 300 is exemplified that may include rain gutter 302 having chamber ingress 304 that may accept flow 312 comprising one or more of precipitation (e.g., rain, melted snow/ice, etc.) and debris (e.g., leaves, pine needles, pine cones, etc.) into chamber 316. As flow 312 enters chamber 316 of rain gutter trap 308 via ingress 304, the debris component of flow 312, if any, may be confined to chamber 316 through operation of gravity and operation of screen 310 while the precipitation component of flow 312 may flow through screen 310 into chamber 322 and may be allowed to egress chamber 322 via downspout egress 320 as clear water flow 318.

As chamber 316 fills with debris, screen 310 may block debris from accessing chamber 322 thereby denying debris access to downspout egress 320 and substantially preventing blockage of downspout 306. Once debris rises within chamber 316 to the height of screen 310, chamber 316 may be cleared of debris so that rain gutter trap 308 may continue to effectively separate debris from precipitation thereby maintaining clog-free operation of downspout 306. It should be noted that access to chamber 322 may be selectively metered exclusively by screen 310 (e.g., no other access to chamber 322 is allowed) such that debris particles exhibiting sizes larger than the mesh openings of screen 310 may be prevented access to chamber 322 while collected precipitation may flow freely from chamber 316, then to chamber 322 and then to downspout 306 via egress 320.

Figure 4:
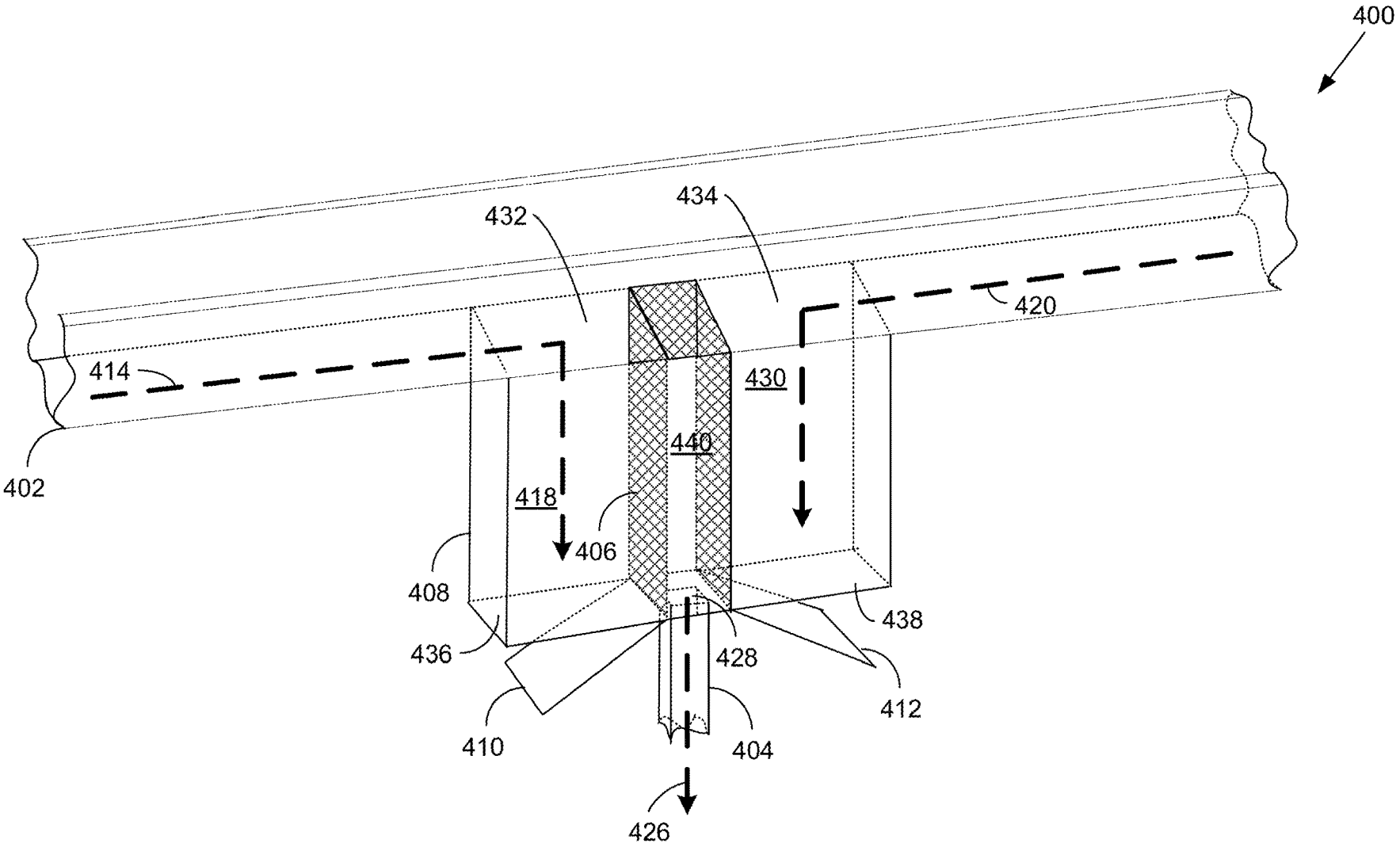
FIG. 4 illustrates a partial view of a rain gutter system including a rain gutter trap in accordance with an alternate embodiment of the present invention.

Turning to FIG. 4, rain gutter system 400 is exemplified that may include rain gutter 402 having chamber ingress 432 and 434 that may accept flows 414 and 420, respectively, each comprising one or more of precipitation (e.g., rain, melted snow/ice, etc.) and debris (e.g., leaves, pine needles, pine cones, etc.) into chambers 418 and 430, respectively. As flows 414 and 420 enter chambers 418 and 430, respectively, of rain gutter trap 408 via ingress 432 and 434, respectively, the debris component of flows 414 and 420, if any, may be confined to chambers 418 and 430, respectively, through operation of gravity and operation of screen 406 while the precipitation component of flows 414 and 420 may flow through screen 406 and may be allowed to egress chambers 418 and 430, respectively, via downspout egress 428 as clear water flow 426.

As chambers 418 and 430 fill with debris, screen 406 may block debris from accessing chamber 440 and downspout egress 428 from either of chambers 418 and 430 thereby preventing blockage of downspout 404. Once debris rises within chambers 418 and/or 430 to the height of screen 406, chambers 418 and 430 may be cleared of debris so that rain gutter trap 408 may continue to separate debris from precipitation thereby maintaining clog-free operation of downspout 404. It should be noted that access to chamber 440 may be selectively metered exclusively by screen 406 (e.g., no other access to chamber 440 is allowed) such that debris particles exhibiting sizes larger than the mesh openings of screen 406 may be prevented access to chamber 440 while collected precipitation may flow freely from chambers 418 and/or 430, then to chamber 440 and then to downspout 404 via egress 428.

In one embodiment, debris may be cleared from chambers 418 and 430 through operation of hinged doors 410 and 412, respectively. Doors 410 and 412 may, for example, be disengaged from rain gutter trap 408 (e.g., via mechanical retention devices not shown) thereby providing temporary openings 436 and 438, respectively, to chambers 418 and 430, respectively. Once doors 410 and 412 are disengaged, debris contained within chambers 418 and/or 430 may be allowed egress through openings 436 and 438, respectively, created by the disengaged doors 410 and 412 into a collection device (e.g., garbage can or bucket not shown).

Once chambers 418 and 430 are cleared of debris, doors 410 and 412 may be reengaged with rain gutter trap 408 (e.g., via mechanical retention devices not shown) thereby closing openings 436 and 438 for substantially waterproof operation of rain gutter trap 408. As per one example, doors 410 and 412 may utilize gaskets (not shown) to create a substantially waterproof seal between doors 410/412 and corresponding portions of rain gutter trap 408 to disallow virtually all collected precipitation to egress rain gutter trap 408 via openings 436 and 438 while doors 410 and 412 are engaged with rain gutter trap 408.

Figure 5A:
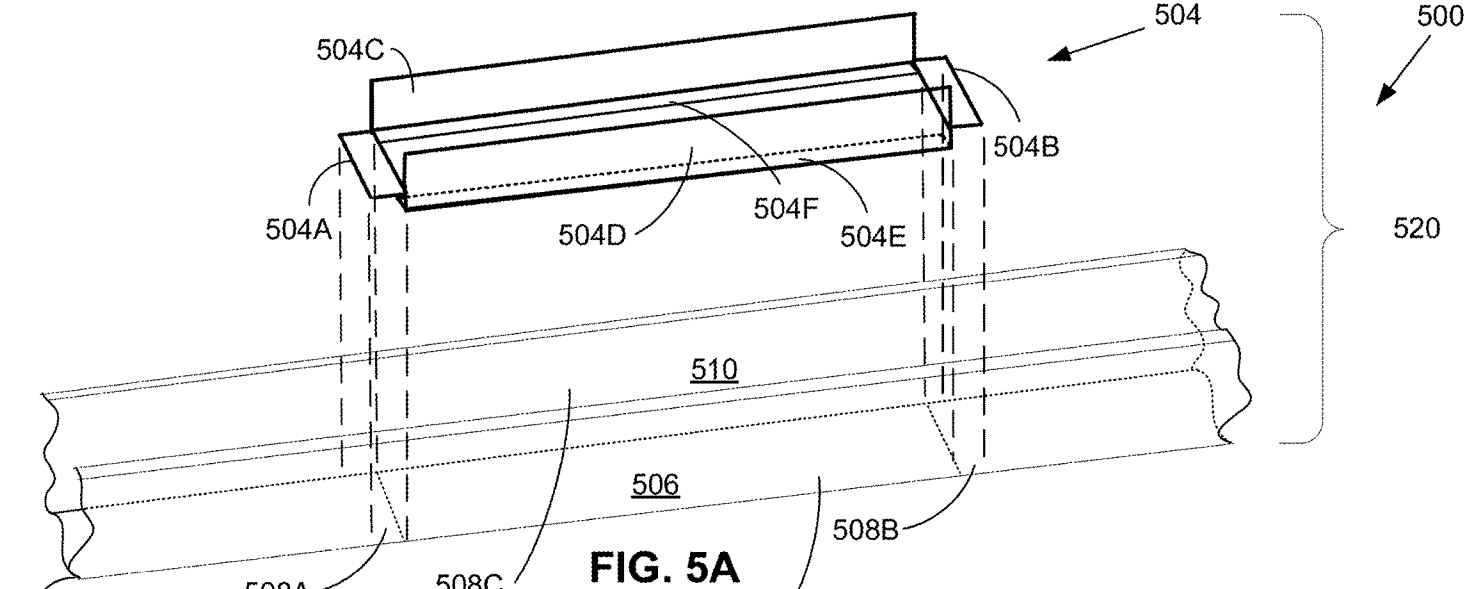
FIGS. 5A, 5B and 5C illustrate exploded partial views of a rain gutter trap system in accordance with alternate embodiments of the present invention.
Figure 5B:
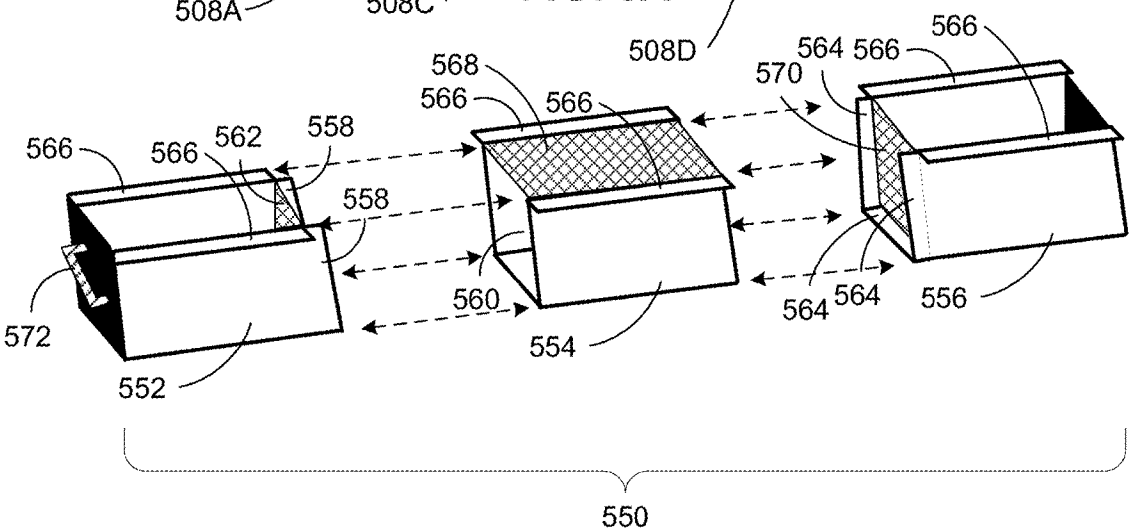
Figure 5C:
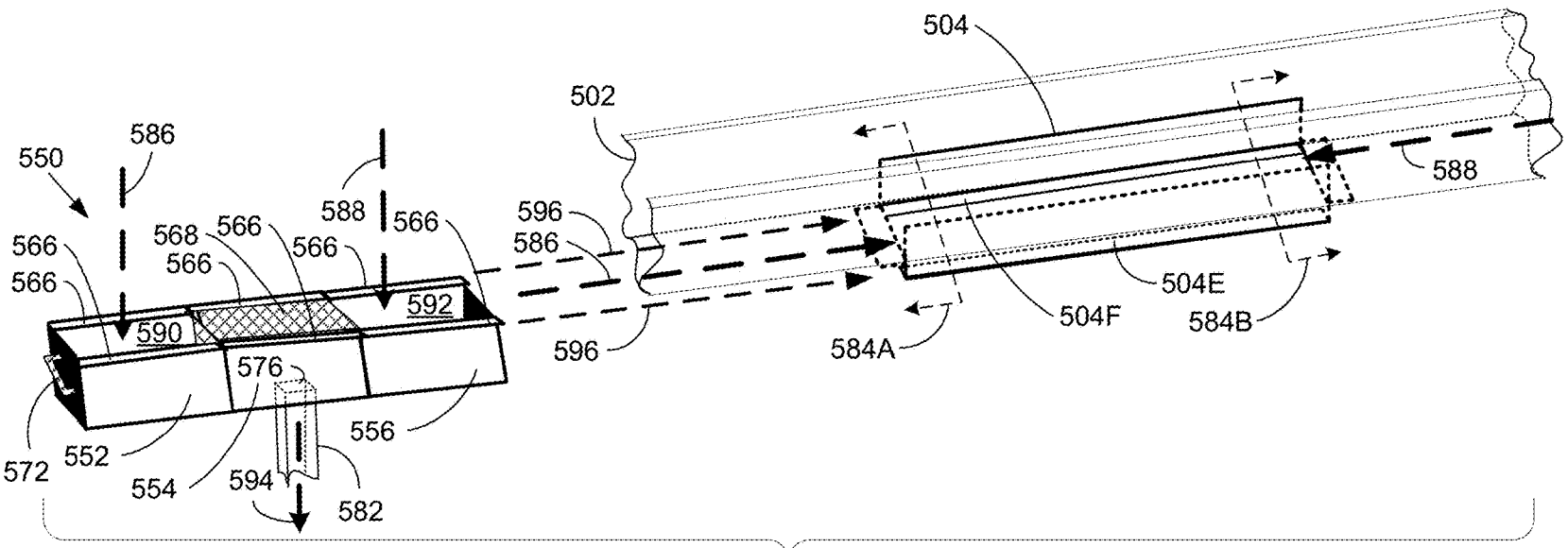

Turning to FIGS. 5A-5C, exploded views 520, 550 and 580, respectively, of rain gutter trap system 500 are exemplified. Exploded view 520 of FIG. 5A exemplifies insert 504 which may be inserted into void 506 existing within a bottom portion of rain gutter 502 such that features 504E and 504F may protrude through void 506 and extend below the bottom of rain gutter 502 while features 504A-504D may remain within interior portion 510 of rain gutter 502. Insert 504 may be secured to rain gutter 502 in a waterproof manner (e.g., via waterproof adhesive) whereby flanges 504A-504D of insert 504 may be adhered to surfaces 508A-508D, respectively, existing within interior portion 510 of rain gutter 502.

FIG. 5B exemplifies an exploded view of rain gutter trap 550 that may exhibit one or more mechanically interlocking components (e.g., components 552, 554 and 556) removably coupled to one another as shown. Component 552 may, for example, include extension tabs 558 that may extend beyond screen 562 and may be removably inserted into interior portion 560 of component 554 such that screen 562 may be brought into close proximity with (e.g., touching) screen 568 of component 554. Similarly, extension tabs 564 of component 556 may, for example, be removably inserted into the end opposite to portion 560 of component 554 such that screen 570 may be brought into close proximity with (e.g., touching) screen 568 of component 554. Handles 572 may, for example, be provisioned onto, or otherwise incorporated within, components 552 and 556 (not shown) and may be used to facilitate detachment and reattachment of components 552 and 556 to component 554. It should be noted that screen 568 may be replaced with a solid component (e.g., a solid sheet of metal such as stainless steel) instead.

As discussed in more detail below in relation to FIG. 5C, components 552, 554 and 556 may each include features (e.g., flanges 566) that may mechanically engage corresponding features (e.g., flanges 504E and 504F) of insert 504 as discussed above in relation to FIG. 5A to provide a mechanism to removably attach components 552, 554 and 556 to rain gutter 502 via insert 504. Such mechanical engagements along with the interlocking mechanisms of components 552, 554 and 556 allow substantially all of the collected precipitation to flow into component 554 and egressed (e.g., via downspout 582 as discussed below in relation to FIG. 5C) while components 552, 554 and 556 remain removably interlocked with insert 504 (e.g., as discussed below in relation to FIG. 5C). Handles 572 may, for example, aid in the engagement and disengagement of components 552 and 556 to/from component 554 when, for example, collected debris needs to be cleared from interior portions of components 552 and 556.

Turning to FIG. 5C, exploded view 580 exemplifies the removable attachment of rain gutter trap 550 to insert 504. Rain gutter trap 550 may include components 552 and 556 with ingresses 590 and 592, respectively, that may accept flows 586 and 588, respectively, each comprising one or more of precipitation (e.g., rain, melted snow/ice, etc.) and debris (e.g., leaves, pine needles, pine cones, etc.) from an interior of rain gutter 502. As flows 586 and 588 enter components 552 and 556, respectively, of rain gutter trap 550, the debris component of flows 586 and 588, if any, may be confined to components 552 and 556, respectively, through operation of gravity and operation of screens 562 and 570, respectively, while the precipitation component of flows 586 and 588 egresses through screens 562 and 570 into component 554 and ultimately via downspout egress 596 and downspout 582 as clear water flow 594.

As components 552 and 556 fill with debris, screens 562 and 570, respectively, may block debris from accessing the interior of component 554 and downspout egress 576 from either of components 552 and 556 thereby preventing blockage of downspout 582. Further, screen 568 may similarly block debris from accessing the interior of component 554. In alternate embodiments, screen 568 may instead be replaced with a solid component (e.g., a solid sheet of stainless steel).

Once debris rises within components 552 and/or 556 (e.g., fills to the height of screens 562 and/or 570, respectively) components 552 and/or 556 may be removed from component 554 (e.g., by pulling on handle 572 in a direction away from component 554) to release the mechanical engagement between flanges 566, 504E and 504F. In so doing, components 552 and/or 556 may be transported to a local receptacle (e.g., trash can) where components 552 and/or 556 may be cleared of debris and subsequently re-engaged with component 554 (e.g., via mechanical engagement between flanges 566, 504E and 504F) so that rain gutter trap 550 may continue to separate debris from precipitation thereby maintaining clog-free operation of downspout 582. It should be noted that access to components 552 and/or 556 may be metered by screens 562 and/or 570, respectively, and optionally by screen 568 such that debris particles exhibiting sizes larger than the mesh openings of screens 562, 570 and/or 568, respectively, may be prevented access to the interior of component 554 while collected precipitation may flow freely from components 552 and/or 556, then to the interior of component 554 and then to downspout 582 via downspout egress 576.

Figure 5E:
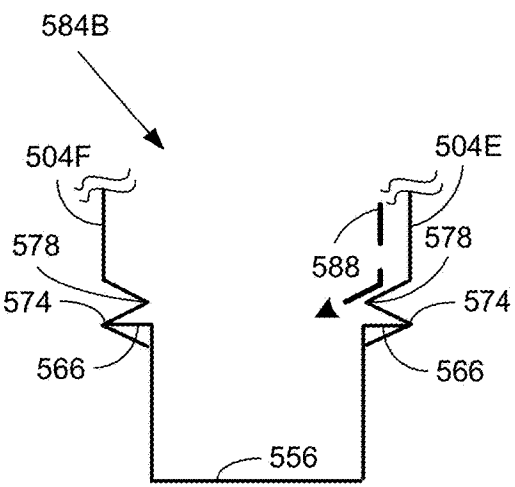
FIGS. 5D and 5E illustrate mechanical engagements of the rain gutter trap system of FIGS. 5A, 5B and 5C in accordance with an embodiment of the present invention.
Figure 5D:
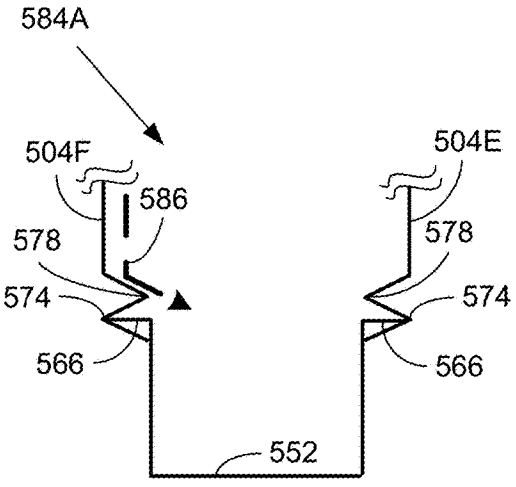

Detail 584A of FIG. 5D exemplifies a mechanical engagement between flanges 566 of rain gutter trap component 552 and corresponding flanges 504E and 504F of insert 504. Similarly, detail 584B of FIG. 5E exemplifies a mechanical engagement between flanges 566 of rain gutter trap component 556 and corresponding flanges 504E and 504F of insert 504. It should be noted that the mechanical engagement (not shown) between flanges 566 of rain gutter trap component 554 and corresponding flanges 504E and 504F of insert 504 is substantially similar to those as shown in FIGS. 5D and 5E.

As shown in FIG. 5D, flanges 566 may removably engage detents 574 such that rain gutter trap component 552 may be removably attached to insert 504. Conversely as shown in FIG. 5E, flanges 566 may removably engage detents 574 such that rain gutter trap component 556 may be removably attached to insert 504. It should be noted that any of components 552, 554 and 556 may be removably attached to insert 504 from either direction 596 or a direction opposite to direction 596 because flanges 504E and 504F may extend the full length of insert 504 and thereby may accept components 552, 554 and 556 from either end of insert 504.

Detents 574 may be configured in any manner (e.g., angled outward as shown) so as to allow engagement of flanges 566 such that the position of components 552, 554 and 556 remains substantially static with respect to insert 504 while components 552, 554 and 556 remain engaged with insert 504. Further, static friction between detents 574 and flanges 566 may be configured so as to be overcome by a reasonable force applied to handles 572 to separate components 552 and 556 from component 554 as discussed above in relation to FIG. 5B. In one embodiment, component 554 may be anchored (e.g., attached to a building's fascia not shown) to prevent movement of component 554 after attachment to insert 504 via flanges 566, 504E and 504F.

Detents 578 may be configured in any manner (e.g., angled inward as shown) so as to allow deflection of flows 586 and 588 toward an interior of components 552 and 556, respectively. As such, any leakage of precipitation from components 552, 554 and 556 may be minimized.

It should be noted that either of components 552 or 556 of rain gutter trap system 500 may be omitted if rain gutter trap system 500 is to be installed at one end of rain gutter 502 or the other. As per one example, rain gutter trap system 500 may be installed at one end of rain gutter 502 such that only one flow (e.g., flow 586) exists as may be the case if rain gutter 502 terminates just to one side (e.g., right side) of component 554. In such an instance, for example, component 556 may be replaced with a component (not shown) that simply terminates rain gutter 502 to disallow flow 586 from egressing rain gutter 502 from any egress except downspout egress 576. Conversely, for example, rain gutter trap system 500 may be installed at one end of rain gutter 502 such that only one flow (e.g., flow 588) exists as may be the case if rain gutter 502 terminates just to one side (e.g., left side) of component 554. In such an instance, for example, component 552 may be replaced with a component (not shown) that simply terminates rain gutter 502 to disallow flow 588 from egressing rain gutter 502 from any egress except downspout egress 576.

Other aspects and embodiments of the present invention will be apparent to those skilled in the art from consideration of the specification and practice of the invention disclosed herein. For example, materials selected for the manufacture of the rain gutter systems discussed herein may be those that are most resilient to harsh weather conditions (e.g., stainless steel, powder coated steel, plastic, vinyl, etc.). It is intended, therefore, that the specification and illustrated embodiments be considered as examples only, with a true scope and spirit of the invention being indicated by the following claims.

What is claimed is:

1. A rain gutter trap, comprising:

a first component configured to allow ingress of water and debris from a first side of the first component and configured to trap the debris and allow egress of only the water from a second side of the first component;

a second component removably coupled to the second side of the first component and configured to accept the water from the first component and configured to allow egress of the water via a downspout egress, wherein the first component is configured to be removed from the second component to allow removal of the debris; and a third component removably coupled to the second component and configured to allow ingress of water and debris from a first side of the third component and configured to trap the debris and allow egress of only the water from a second side of the third component to the second component.

2. The rain gutter trap of claim 1, wherein the first, second and second third components are removably coupled to a rain gutter.

3. The rain gutter trap of claim 2, wherein the first side of the first and third components are configured to allow ingress of water and debris from the rain gutter.

* * * * *